US007352130B2

(12) United States Patent
Helbing et al.

(10) Patent No.: US 7,352,130 B2
(45) Date of Patent: Apr. 1, 2008

(54) ARC DISCHARGE FLASHLAMP

(75) Inventors: Rene P. Helbing, Palo Alto, CA (US); Charles D. Hoke, Menlo Park, CA (US)

(73) Assignee: Avago Technologies General IP Pte Ltd, Singapore (SG)

( * ) Notice: Subject to any disclaimer, the term of this patent is extended or adjusted under 35 U.S.C. 154(b) by 35 days.

(21) Appl. No.: 11/084,597

(22) Filed: Mar. 17, 2005

(65) Prior Publication Data

US 2006/0208652 A1 Sep. 21, 2006

(51) Int. Cl.
*H01J 17/16* (2006.01)

(52) U.S. Cl. ..... 313/635; 313/634; 313/494; 313/101; 313/503

(58) Field of Classification Search ..... 313/635, 313/634, 485, 486, 494, 495, 503, 501, 110
See application file for complete search history.

(56) References Cited

U.S. PATENT DOCUMENTS

| | | | | |
|---|---|---|---|---|
| 4,257,765 | A | 3/1981 | Potter et al. | |
| 4,767,965 | A * | 8/1988 | Yamano et al. | 313/491 |
| 4,822,145 | A * | 4/1989 | Staelin | 349/63 |
| 7,178,944 | B2 * | 2/2007 | Walton | 362/260 |
| 2001/0024088 | A1 * | 9/2001 | Justel et al. | 313/587 |
| 2004/0051438 | A1 * | 3/2004 | Leblans et al. | 313/467 |
| 2005/0168124 | A1 * | 8/2005 | Justel et al. | 313/486 |
| 2005/0218810 | A1 * | 10/2005 | Kwok et al. | 313/635 |

* cited by examiner

*Primary Examiner*—Tuyet Vo

(57) ABSTRACT

First and second substrates are spaced apart and joined around a perimeter to define a gas chamber between the substrates. The first substrate is made of a material that transmits visible radiation. A layer of a phosphor material overlies an interior surface of one of the substrates and is capable of converting UV radiation to visible radiation. A layer of a reflective material overlies an interior surface of the other one of the substrates.

11 Claims, 4 Drawing Sheets

ARC DISCHARGE FLASHLAMP

BACKGROUND OF THE INVENTION

Compact digital still cameras (DSCs) and camera cell phones often utilize relatively small image sensors with minute pixel sizes to reduce the size and cost of the image sensor. However, the light gathering ability of such small image sensors is often not suitable in low ambient light conditions for the desired quality of the image captured. This is especially the case with camera cell phones because the users of such devices often take snap shots in dimly lit indoor settings. Therefore, compact digital still cameras and camera cell phones typically incorporate flashlamps which enable acceptable pictures to be taken in relatively low ambient light conditions.

A type of flashlamp commonly used in compact digital still cameras and camera cell phones is the xenon arc discharge lamp. The atoms or molecules of gas inside a glass, quartz, or translucent ceramic tube, are ionized by an electric current through the gas or a radio frequency (RF) or microwave field in proximity to the tube. The ionization results in the generation of light—usually either visible or ultraviolet (UV), although some infrared (IR) light may be emitted as well. The color temperature of the light that is emitted by an arc discharge lamp depends on both the mixture of gases or other materials inside the tube or envelope as well as the pressure and the amount and type of energization. Xenon arc discharge lamps are mostly filled with xenon gas and usually reach their peak output immediately after ignition, making them suitable for use as flashlamps in cameras.

When used in a camera device, a xenon arc discharge lamp requires a secondary stored energy source for operation, which is typically a capacitor that is charged through a circuit connected to a rechargeable battery. The capacitor is often larger than the flashlamp and this presents a problem in designing compact camera devices.

A xenon arc discharge lamp converts electrical energy into optical energy in a relatively efficient manner. However, the optical efficacy is relatively low because the emitted spectrum resembles that emitted by a black body radiator with a very high color temperature, i.e. approximately 12,000 degrees Kelvin (K). Hence, many of the generated photons have energy frequencies higher than that of visible light, i.e. they are emitted in the ultraviolet (UV) range between about 200 and 400 nanometers (nm). For efficient discharge conditions, the amount of UV radiation emitted by a xenon arc discharge lamp can actually exceed the amount of visible radiation that is emitted. For visible application like photo flash, the current density at discharge is typically decreased, trading off electrical-to-optical conversion efficiency and output of visible light. Alternatively, at high conversion efficiencies, the UV light is usually absorbed by the glass envelope of the xenon arc discharge lamp. In addition, a yellow filter is sometimes employed to reduce the amount of generated deep blue light and to adjust the color temperature of the flashlamp. FIG. 1 is a graph illustrating typical spectral distributions and window transmissions of a conventional xenon arc discharge lamp. In FIG. 1 the wavelength is in nanometers (nm) and the light output distribution is in percentages (%). In this example, the optical distribution is greater than thirty-five percent (35%) of UV light and about twenty-six percent (26%) for the visible fraction (approximately 400 nm to 700 nm).

SUMMARY OF THE INVENTION

A flashlamp includes first and second substrates spaced apart and joined around a perimeter by a support to define a gas chamber between the substrates. The first substrate is made of a material that transmits visible radiation. A layer of a phosphor material overlies an interior surface of one of the substrates and is capable of converting UV radiation to visible radiation. A layer of a reflective material overlies an interior surface of the other one of the substrates.

BRIEF DESCRIPTION OF THE DRAWINGS

Throughout the drawing figures, like reference numerals refer to like parts.

DETAILED DESCRIPTION

If a camera device requires a flashlamp having a ten lumensecond output, and if the flashlamp has a conversion efficiency of ten lumens per watt, the capacitor must store one watt second which equals one joule. If the flashlamp had an improved efficiency of twenty lumens per watt, the capacitor would only need to store one-half joule. Hence, it would be reasonable to expect that the physical size of the capacitor could be reduced by approximately fifty percent. Improved efficiency of the flashlamp can also result in power savings, so that more pictures can be taken before the battery must be recharged.

Figure 1:
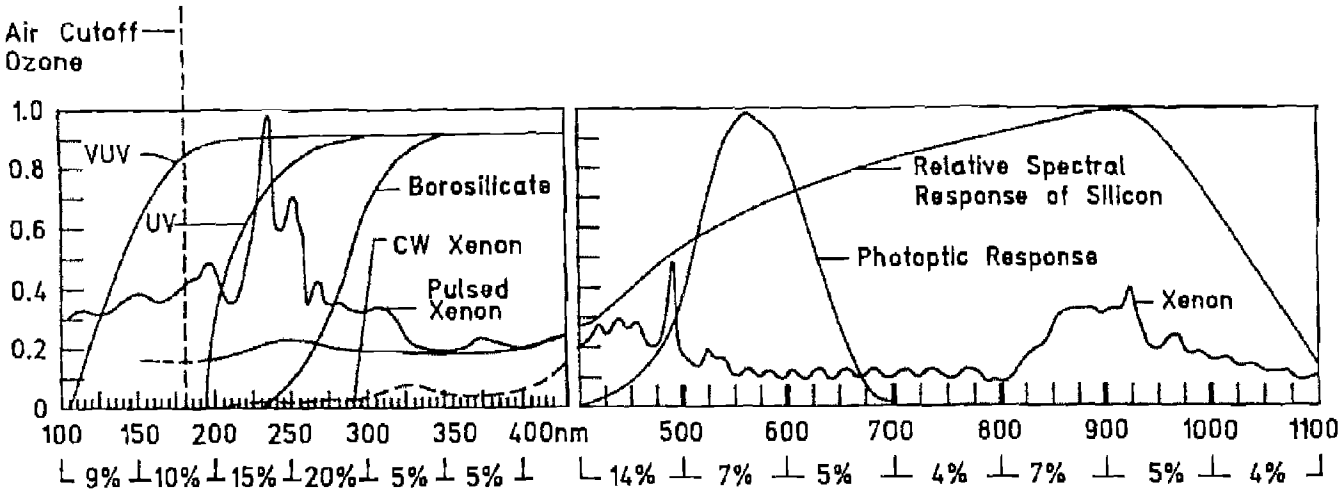
FIG. 1 (PRIOR ART)
FIG. 1 is a graph illustrating the typical spectral distributions and window transmissions of a conventional xenon arc discharge lamp.
Figure 2:
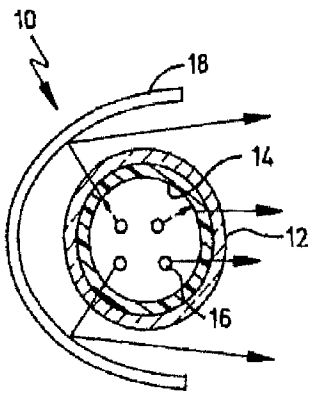
FIG. 2 is a diagrammatic cross-sectional view illustrating a first embodiment in accordance with the invention in the form a cylindrical arc discharge flashlamp positioned adjacent a reflector.

FIG. 2 illustrates a first embodiment in accordance with the invention in the form an illumination system that includes arc discharge flashlamp 10 having cylindrical envelope 12 with a phosphor coating 14 on its inside surface made of a phosphor material. Envelope 12 may be made of glass, quartz, or translucent ceramic material. Envelope 12 is filled with a fill gas that may be under ambient pressure, elevated pressure, or less than atomosphereic pressure. The fill gas may comprise xenon, krypton, argon, neon and mixtures thereof. The fill gas is illustrated diagrammatically by spheres 16 inside envelope 12. Coating 14 converts UV light (dashed arrows) emitted by ionized fill gas to visible light (solid arrows) which is transmitted through coating 14 to the object of interest. Not illustrated are a pair of electrodes that terminate within envelope 12 to which a suitable electrical signal is applied to ionize the fill gas. Some of the visible light is captured and re-radiated in the forward direction by surrounding external reflector 18 which may have a cylindrical, parabolic or elliptical configuration. The composition of phosphor coating 14 depends on the output spectrum of the arc discharge (the excitation source) and the desired emission of the lamp. Typically, the same compositions used in conventional fluorescent light tubes, plasma displays and in conjunction with light emitting diodes (LEDs) could be applied. Common phosphors and phosphor mixtures are known to those skilled in the art of designing gas discharge lamps. The diameter of envelope 12 is preferably relatively small, for example, one or two millimeters, so that flashlamp 10 can be incorporated into a compact digital still camera or camera cell phone (not illustrated). The increased efficiency of flashlamp 10 allows a smaller capacitor to be used as the energy source and also results in power savings.

Figure 3A:
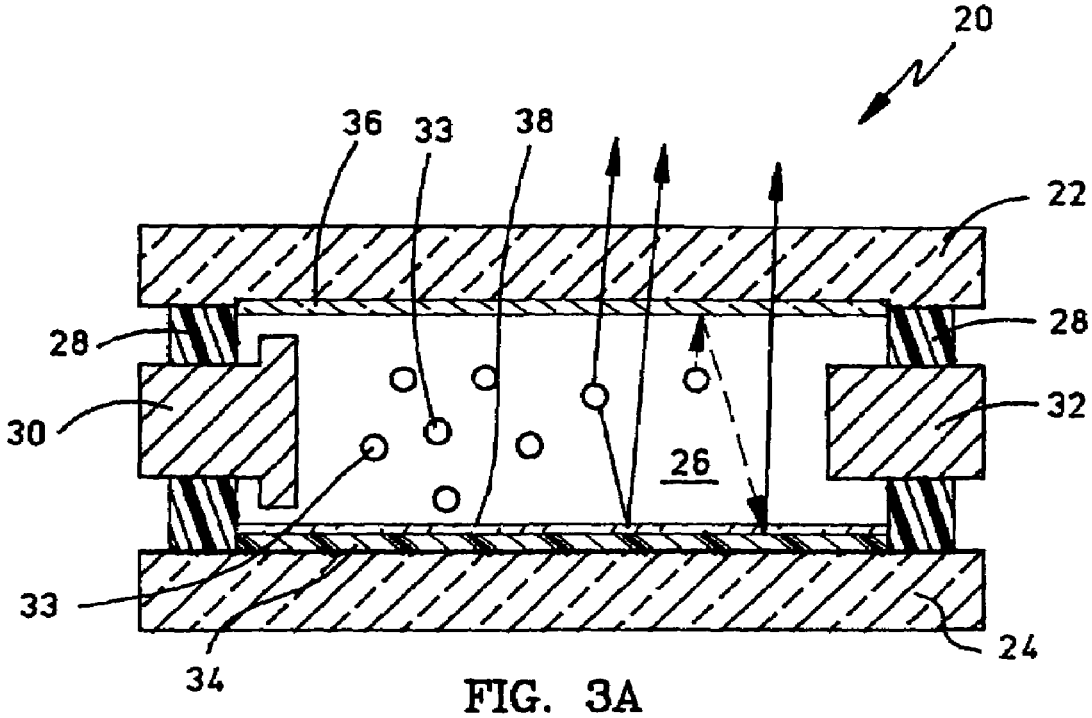
FIGS. 3A and 3B are diagrammatic cross-sectional views illustrating alternate embodiments in accordance with the invention employing planar components.
Figure 3B:
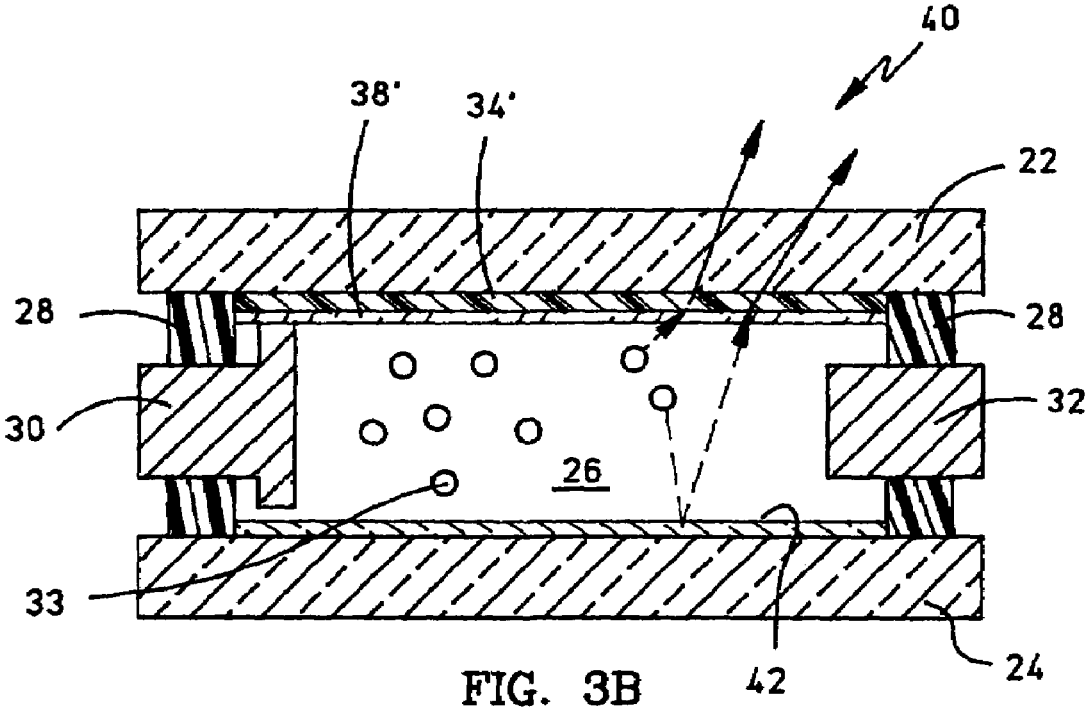

From a manufacturing processes standpoint, it may be difficult to deposit a high quality phosphor material coating 14 onto the interior of small cylindrical envelope 12. Moreover, the arc discharge of flashlamp 10 creates a burst of high-energy plasma that could damage phosphor material coating 14 and impair its UV conversion capability. FIGS. 3A and 3B illustrate alternate embodiments in accordance with the invention that utilize planar substrates and coatings in order to alleviate the aforementioned problems associated with cylindrical flashlamp 10.

Referring to FIG. 3A, high efficiency flashlamp 20 includes upper (first) generally planar visible light transmitting substrate 22 and lower (second) generally planar substrate 24. First substrate 22 and second substrate 24 are supported in generally parallel, spaced apart relationship to define sealed gas chamber 26 between the two substrates. This is accomplished with perimeter wall structure 28. First substrate 22 is preferably made of glass, quartz or translucent ceramic material. Second substrate 24 is preferably made of the same material as first substrate 22, although it can be made of a material that does not transmit visible light. However it is advantageous that second substrate 24 be made of a material with the same coefficient of thermal expansion as that of first substrate 22.

Electrodes 30 and 32 (FIG. 3A) extend through t wall structure 28 which supports their inner ends within gas chamber 26. Fill gas is contained in an airtight manner inside sealed gas chamber 26. The fill gas may be under elevated pressure relative to ambient and is capable of ionization via a suitable electric current applied to electrodes 30 and 32 so that the ionized fill gas emits radiation in both the visible and ultraviolet (UV) portions of the electromagnetic spectrum. A separate circuit (not illustrated) can be used to help ignite flashlamp 20. In FIG. 3A the molecules of the fill gas are illustrated diagrammatically by spheres 33. Electrodes are not necessary as ionization can be accomplished by suitable application of microwave or RF energy. Layer 34 of phosphor coats an interior surface of lower substrate 24. The phosphor material is of a known type that is capable of converting UV radiation to visible radiation. Layer 36 of UV reflective material coats an interior surface of upper substrate 22. Layer 38 of a suitable protective material overlies phosphor material layer 34.

The impedance and discharge current of flashlamp 20, as well as the other embodiments in accordance with the invention, are selected to achieve the highest electrical-to-optical conversion, even if most of the initial emission of the fill gas is UV radiation. When the fill gas is ionized the visible part of the radiation emitted thereby (solid arrows in FIG. 3A) is transmitted through upper substrate 22 to the object of interest. Some of the visible radiation generated by the ionized fill gas is transmitted directly through UV reflective layer 36 and then through upper substrate 22. The remainder of the visible radiation emitted by the ionized fill gas is indirectly transmitted as it reflects off the layers overlying lower substrate 24 before passing through UV reflective layer 36 and then through upper substrate 22. The UV radiation emitted by the ionized fill gas (dashed arrows in FIG. 3A) is directly transmitted to phosphor layer 34 or is reflected off of UV reflective layer 36 to phosphor material layer 34. Phosphor layer 34 converts the UV radiation to radiation in the visible part of the electromagnetic spectrum, which then is transmitted through UV reflective layer 36 and through upper substrate 22 to the object of interest.

Perimeter wall structure 28 of flashlamp 20 is illustrated in diagrammatic form in FIG. 3A. Perimeter wall structure 28 could be a discrete rectangular frame of suitable dimensions sandwiched between and bonded to upper and lower substrates 22 and 24 to define sealed gas chamber 26 between the substrates. Perimeter wall structure 28 thus provides a support for holding upper and lower planar substrates 22 and 24 in parallel spaced apart relation and joins them around their perimeters to define sealed gas chamber 26. Alternatively, fabrication processes similar to those employed in manufacturing plasma displays can be employed whereby a flexible layer is used to etch or sandblast a grid of miniature cavities in a sheet of glass which would form a plurality of perimeter wall structures 28. These wall structures would be sandwiched between upper and lower substrates 22 and 24 to create an array of flashlamp cells that together would comprise the flashlamp.

Electrodes 30 and 32 (FIG. 3A) can be integrated into the structure as discrete components (shown diagrammatically as anode 30 and cathode 32) or they can be fabricated as conductive traces (not illustrated) by screen printing a suitable thick film material. Layer 34 of phosphor can be deposied onto lower substrate 24 using conventional deposition techniques. Protective layer 38 may be made of a suitable refractory coating such as silicon dioxide. UV reflective layer 36, that also transmits visible radiation, effectively can be a dielectric mirror or a nano-particle layer, for example. For efficient use of the generated UV radiation, it is advantageous to design UV reflective layer 36 with a high reflectivity for UV radiation over a large range of angles. Increased reflection of visible radiation at higher angles, which is typical for this kind of filter, does not decrease the light output of flashlamp 20. Reflected UV radiation is recycled by diffuse reflection off the back of lower substrate 24 until it is transmitted through upper substrate 22. In addition, the increased reflection of visible light at higher angles actually helps control the emission angle of flashlamp 20, making it easier to direct the generated emission. The appropriate mixture of phosphors is selected based on the appropriate weight percentages of phosphors having the desired excitation wavelength, emission wavelength and absorption wavelength.

FIG. 3B illustrates another embodiment 40 in accordance with the invention which is similar in construction to flashlamp 20 illustrated in FIG. 3A as indicated by the like reference numerals indicating like parts. However, in flashlamp 40, layer 34' of phosphor material overlies the interior surface of upper substrate 22 and layer 38' of protective material overlies layer 34' of phosphor material. Metallic reflective layer 42 overlies the interior surface of lower substrate 24. In this embodiment layer 34' of phosphor material needs to both efficiently convert UV radiation to visible radiation and transmit therethrough the generated visible radiation as well as visible light generated by the arc discharge. However, at a lower thickness that promotes efficient transmission of visible light, most of the UV radiation will pass through the phosphor layer without conversion and is typically absorbed in the outer envelope of the flashlamp.

Phosphor material coating 14 in FIG. 2, phosphor material layer 34 in FIG. 3A, and phosphor material layer 34' in FIG. 3B preferably have a thickness of between about five microns and one hundred microns, and more preferably, between about twenty to thirty microns. The phosphor coating or layer must be thin enough not to absorb too much visible light but not so thin that undue amounts of UV radiation will pass therethrough without being converted to visible radiation.

Figure 4A:
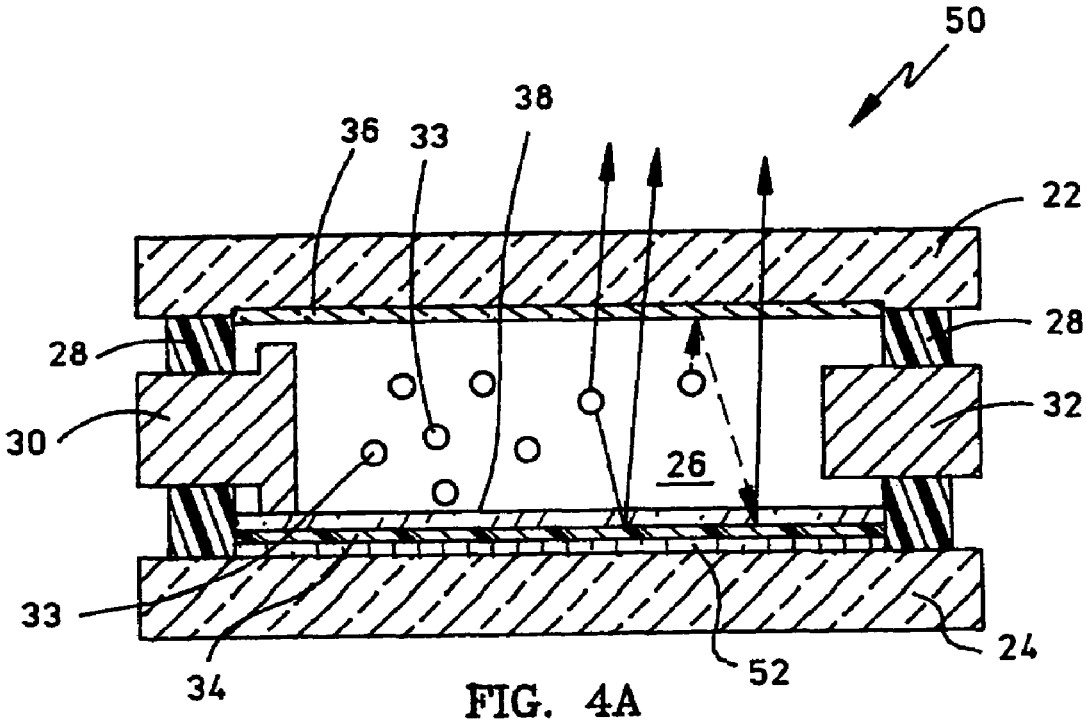
FIGS. 4A, 4B, 5 and 6 are diagrammatic cross-sectional views illustrating further alternate embodiments in accordance with the invention.

Referring to FIG. 4A, an alternate embodiment 50 in accordance with the invention is similar to flashlamp 20 of FIG. 3A except that in the former metallic reflective layer 52 is sandwiched between the interior surface of lower substrate 24 and layer 34 of phosphor material. This permits conversion layer 34 to be relatively thin so that any UV radiation that passes therethrough will be reflected back to UV reflective layer 36 and then back to layer 34 for further conversion to visible radiation.

Figure 4B:
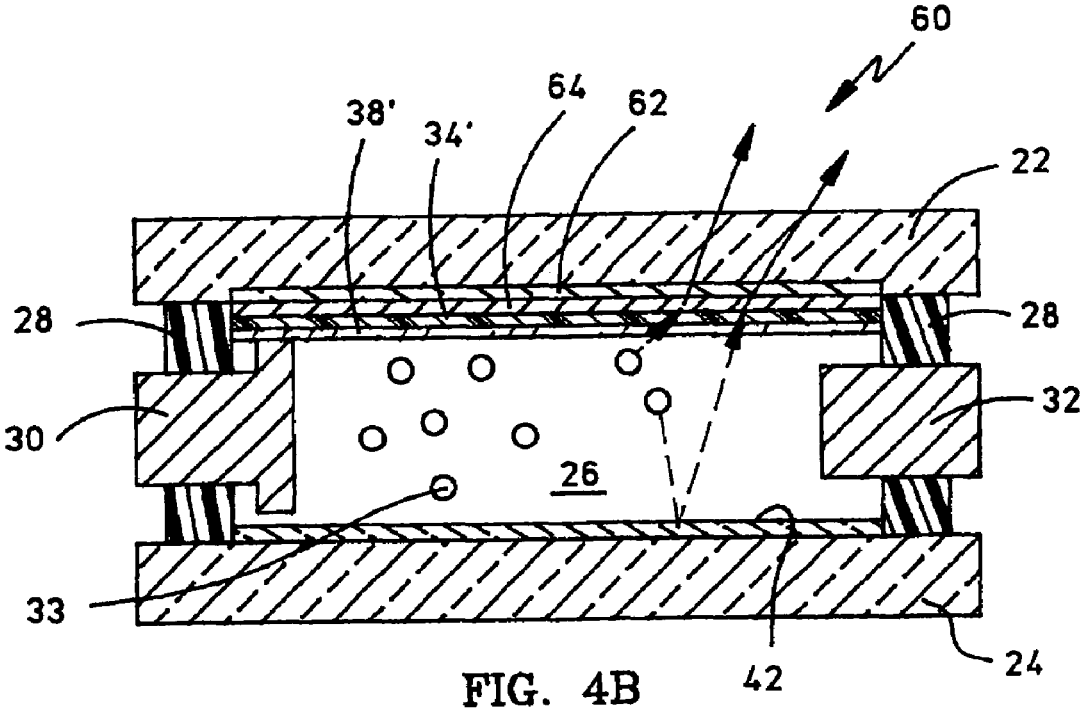

Referring to FIG. 4B, embodiment 60 in accordance with the invention is similar to flashlamp 40 of FIG. 3B except that in the former UV reflective layer 62 is sandwiched between the interior surface of upper substrate 22 and layer 34' of phosphor material. Extra layer 64 of protective material is sandwiched between layer 34' and UV reflective layer 62. This configuration allows the thickness of layer 34' of phosphor material to be relatively thin.

Figure 5:
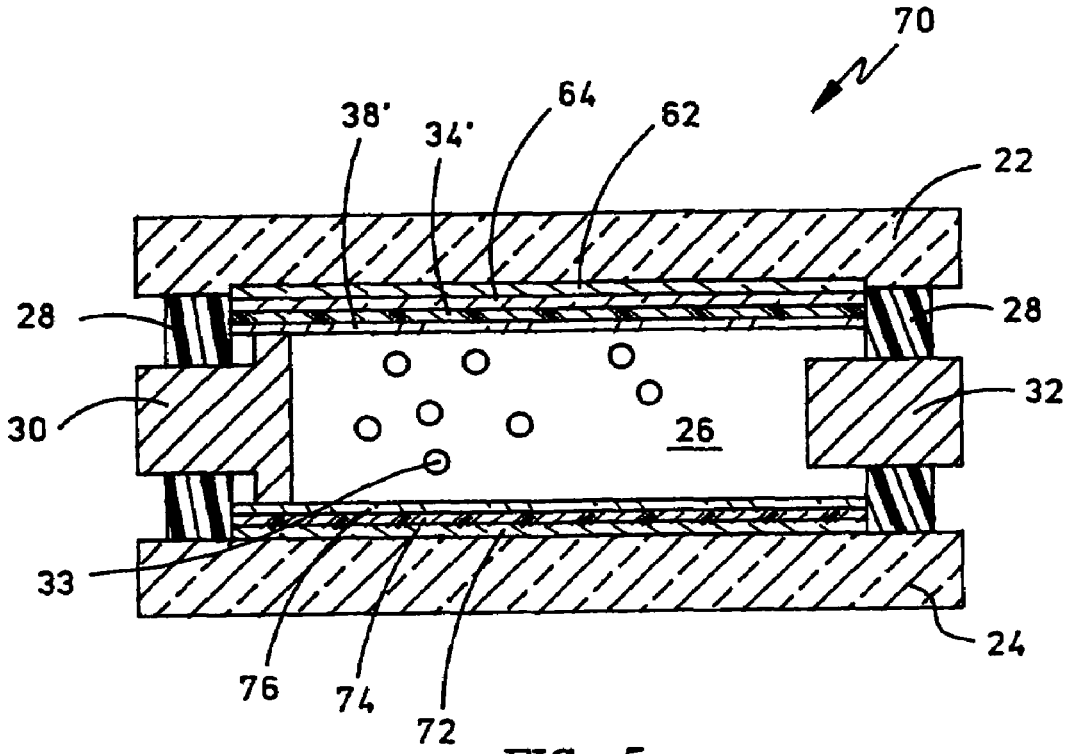

Referring to FIG. 5, embodiment 70 in accordance with the invention has upper and lower substrates 22 and 24 made of material transparent to visible radiation so that it can be used with a reflector (not illustrated) for collecting and re-radiating visible light emitted from one side thereof. Flashlamp 70 is similar to embodiment 60 of FIG. 4B but the former has an additional multi-layer structure of UV reflective layer 72, layer 74 of phosphor material, and protective layer 76 overlying the interior surface of lower substrate 24.

Figure 6:
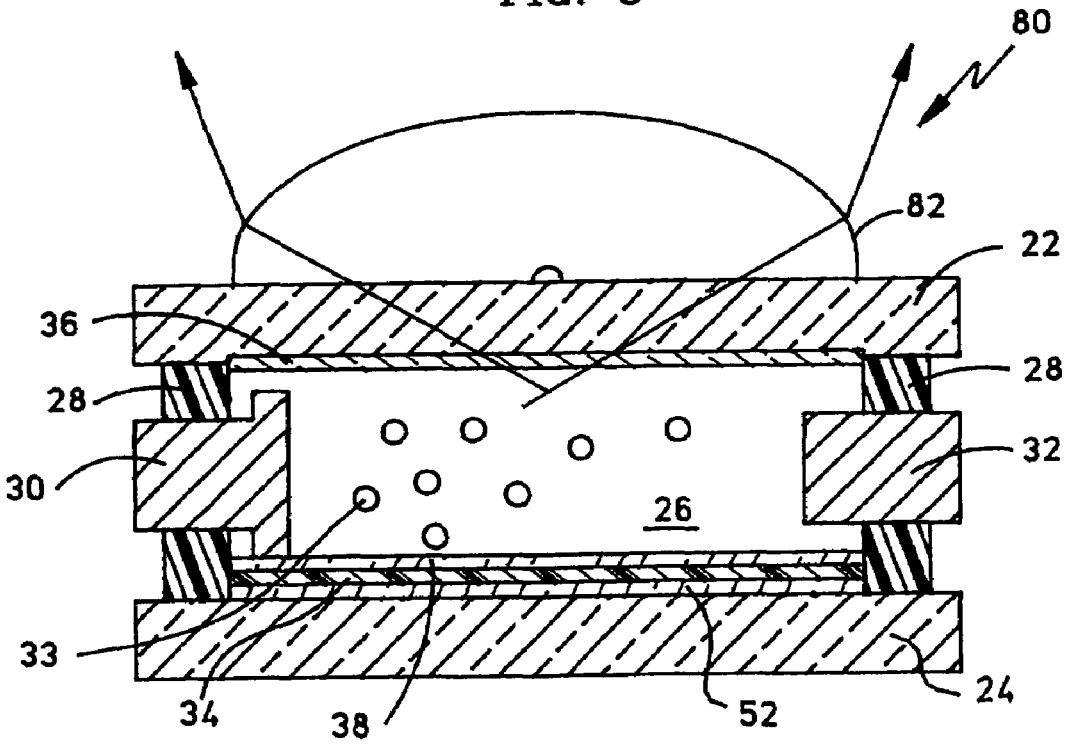

The alternate embodiment 80 of FIG. 6 in accordance with the invention is similar to embodiment 50 of FIG. 4A but the former includes dome-shaped convex lens 82 made of a suitable material transparent to visible radiation attached to the exterior surface of upper substrate 22. Lens 82 collects and focuses the visible radiation emitted by the arc discharge lamp into a beam. The shape and dimensions of lens 82 can be varied depending upon the desired pattern of light and the amount of diffusion, if any, that is desired.

While we have described several embodiments in accordance with the invention, modifications thereof will be obvious to those skilled in the art. For example, the concepts of the flashlamps of FIGS. 3A, 3B, 4A, 4B, 5 and 6 could be employed in a cylindrical or generally tubular transparent envelope instead of using opposing generally planar substrates. The protective layers are optional. They could overlie the UV reflective layer, the metallic reflective layer, or the phosphor layer, or any combination of the same Therefore, the protection afforded our invention should only be limited in accordance with the scope of the following claims.

The invention claimed is:

1. A flashlamp, comprising:

a first visible radiation transmitting substrate;

a second substrate;

a support holding the first and second substrates in spaced apart relationship to define a gas chamber between the substrates;

a layer of a phosphor material overlying an interior surface of one of the substrates, the material being capable of converting UV radiation to visible radiation; and a layer of a reflective material overlying an interior surface of the other one of the substrates;

a pair of electrodes supported within the sealed gas chamber;

a quantity of a gas filling the sealed gas chamber, the gas ionized being capable of ionization via an electric current applied to the electrodes so that the ionized gas emits radiation in both the visible and ultraviolet (UV) portions of the electromagnetic spectrum.

2. The flashlamp of claim 1 and further comprising a layer of a protective material overlying the layer of phosphor material.

3. The flashlamp of claim 1 wherein the layer of phosphor material overlies an interior surface of the second substrate and the layer of reflective material overlies an interior surface of the first substrate and reflects UV radiation but allows visible radiation to be transmitted therethrough.

4. The flashlamp of claim 1 wherein the gas is selected from the group consisting of xenon, krypton, argon, neon and mixtures thereof.

5. The flashlamp of claim 1 wherein the substrates are generally planar.

6. The flashlamp of claim 1 wherein the substrates are made of a material selected from the group consisting of glass, quartz and translucent ceramic material.

7. The flashlamp of claim 1 wherein the layer of phosphor material overlies an interior surface of the first substrate and the layer of reflective material overlies an interior surface of the second substrate.

8. The flashlamp of claim 7 wherein the reflective material is metal.

9. A flashlamp, comprising:

a first visible radiation transmitting substrate;

a second substrate;

a support holding the first and second substrates in spaced apart relationship to define a gas chamber between the substrates;

a layer of UV reflective material overlying the first substrate;

a layer of a phosphor material overlying an interior surface of the second substrate, the material ionized being capable of converting UV radiation to visible radiation; and a layer of protective material overlying the layer of phosphor material.

10. The flashlamp of claim 9 and further comprising a pair of electrodes supported within the sealed gas chamber.

11. The flashlamp of claim 9 wherein the substrates are substantially planar.

* * * * *

UNITED STATES PATENT AND TRADEMARK OFFICE

CERTIFICATE OF CORRECTION

PATENT NO. : 7,352,130 B2
APPLICATION NO. : 11/084597
DATED : April 1, 2008
INVENTOR(S) : Rene P. Helbing et al.

It is certified that error appears in the above-identified patent and that said Letters Patent is hereby corrected as shown below:

Column 6, Line 11, Claim 1, delete "ionized being capable of ionization" and insert -- being ionized --;

Column 8, Line 15, Claim 2, after "claim 1" delete "and";

Column 6, Line 48-49, Claim 9, delete "ionized being capable of converting" and insert -- being converted --;

Column 6, Line 54, Claim 10, after "claim 9" delete "and".

Signed and Sealed this

First Day of June, 2010

David J. Kappos

David J. Kappos
*Director of the United States Patent and Trademark Office*